US009099028B2

(12) United States Patent
Takagi

(10) Patent No.: US 9,099,028 B2
(45) Date of Patent: Aug. 4, 2015

(54) RGBW DYNAMIC COLOR FIDELITY CONTROL

(71) Applicant: Intel Corporation, Santa Clara, CA (US)

(72) Inventor: Akihiro Takagi, San Mateo, CA (US)

(73) Assignee: Intel Corporation, Santa Clara, CA (US)

( * ) Notice: Subject to any disclaimer, the term of this patent is extended or adjusted under 35 U.S.C. 154(b) by 68 days.

(21) Appl. No.: 13/931,455

(22) Filed: Jun. 28, 2013

(65) Prior Publication Data

US 2015/0002552 A1 Jan. 1, 2015

(51) Int. Cl.
*G09G 5/10* (2006.01)
*G09G 3/20* (2006.01)

(52) U.S. Cl.
CPC ..... *G09G 3/2003* (2013.01)

(58) Field of Classification Search
CPC ..... G09G 2320/0233; G09G 2320/0242; G09G 2320/0666; G09G 2320/0673; G09G 2300/0452
USPC ..... 345/102
See application file for complete search history.

(56) References Cited

U.S. PATENT DOCUMENTS

| | | | | |
|---|---|---|---|---|
| 2008/0049048 | A1 | 2/2008 | Credelle et al. | |
| 2009/0070606 | A1* | 3/2009 | Chen et al. | 713/320 |
| 2009/0278867 | A1 | 11/2009 | Elliott et al. | |
| 2009/0284457 | A1* | 11/2009 | Botzas et al. | 345/102 |
| 2010/0074553 | A1* | 3/2010 | Choi et al. | 382/274 |
| 2010/0103187 | A1* | 4/2010 | Linssen | 345/590 |
| 2010/0156884 | A1 | 6/2010 | Ahn et al. | |
| 2013/0222436 | A1* | 8/2013 | Park et al. | 345/690 |
| 2014/0043357 | A1* | 2/2014 | Yamato et al. | 345/603 |
| 2014/0204321 | A1* | 7/2014 | Koh et al. | 349/109 |

FOREIGN PATENT DOCUMENTS

| | | | |
|---|---|---|---|
| JP | 2001-209047 | A | 8/2001 |
| JP | 2008-139528 | A | 6/2008 |

OTHER PUBLICATIONS

International Search Report and Written Opinion received for PCT Patent Application No. PCT/US2014/042864, mailed on Oct. 8, 2014, 13 pages.

* cited by examiner

*Primary Examiner* — Gene W Lee
(74) *Attorney, Agent, or Firm* — Jordan IP Law, LLC

(57) ABSTRACT

Systems and methods may provide for determining a mode of operation associated with a Red, Green, Blue, White (RGBW) display and controlling a yellow-to-white (Y/W) luminance ratio of the RGBW display based on the mode of operation. In one example, the Y/W luminance ratio is decreased if the RGBW display is in a low power mode and increased if the RGBW display is in a high color fidelity mode.

20 Claims, 4 Drawing Sheets

FIG. 2
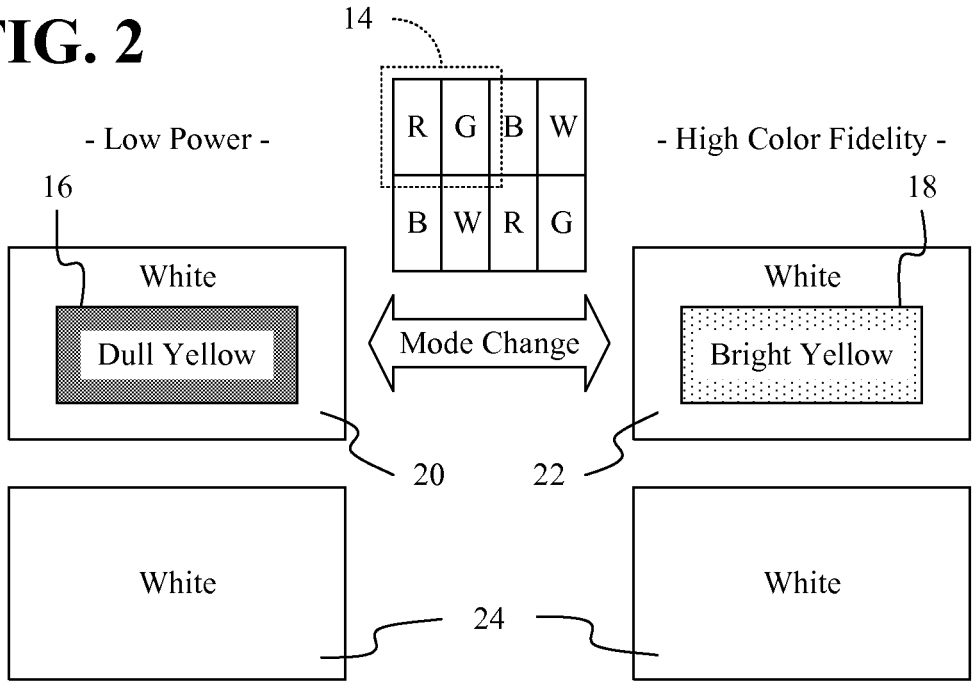
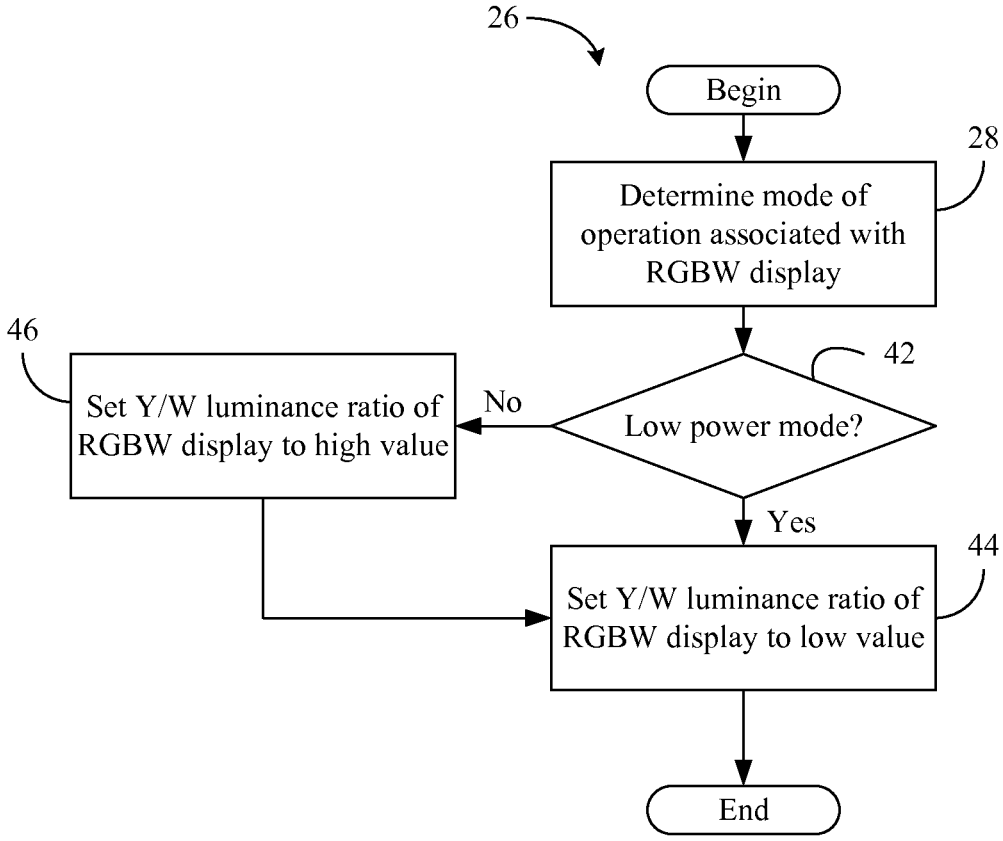
FIG. 3

FIG. 4
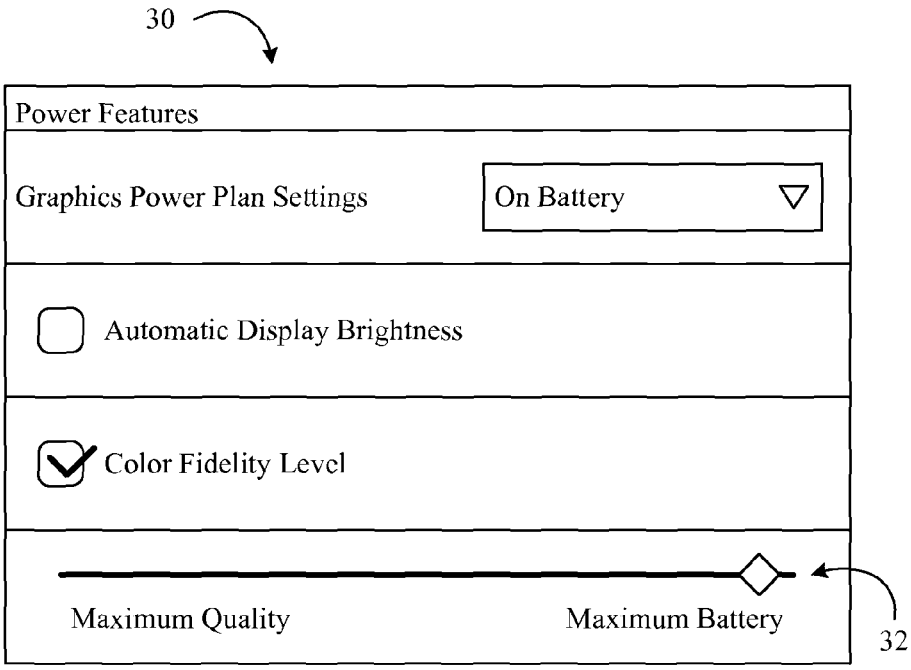
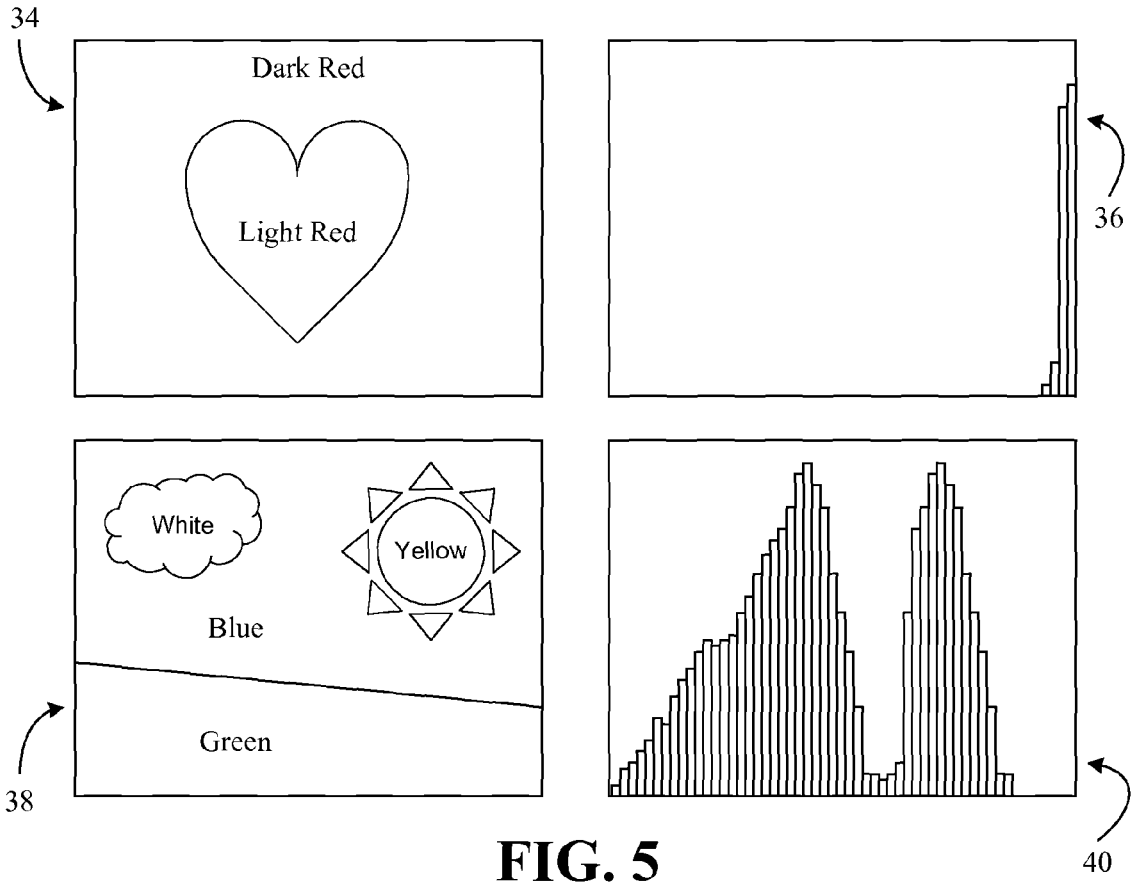
FIG. 5

FIG. 6
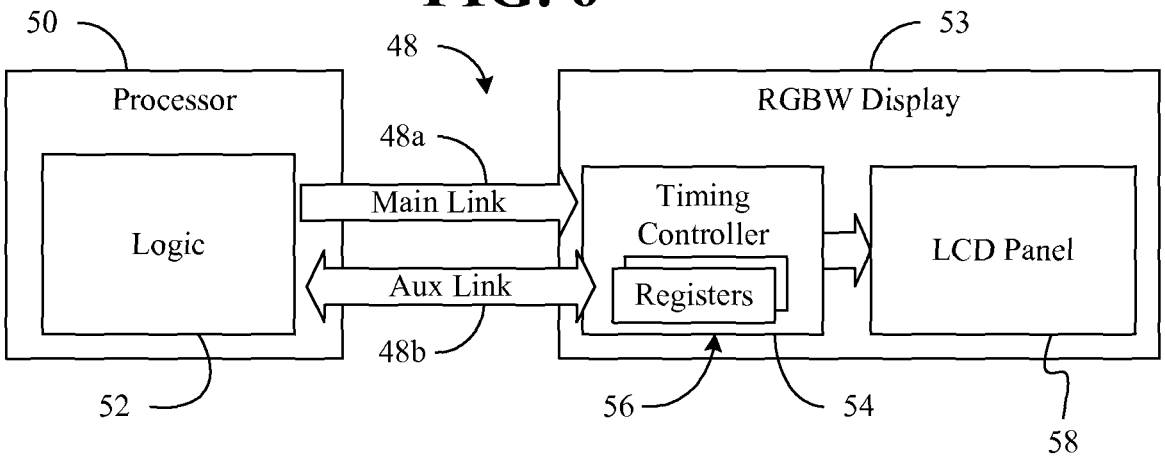
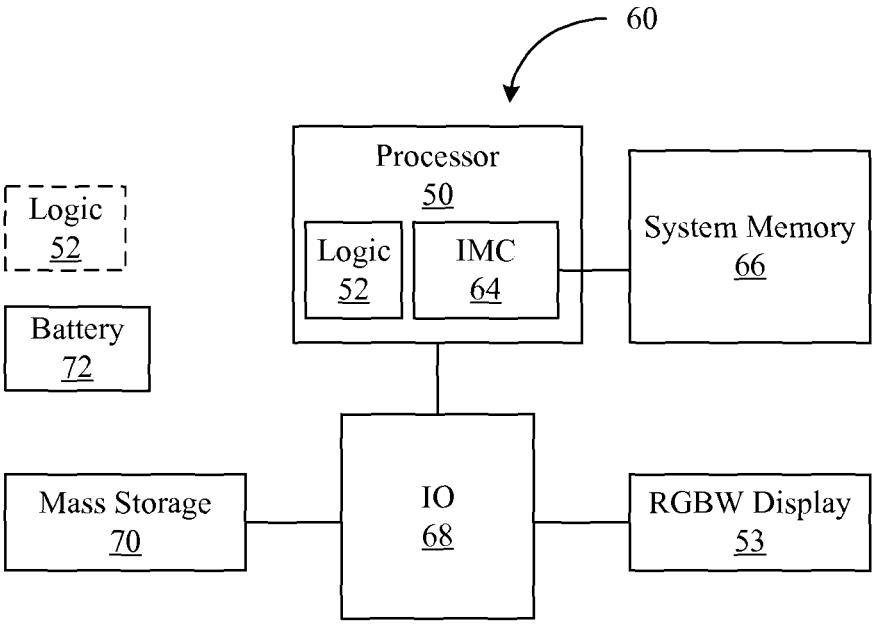
FIG. 7

RGBW DYNAMIC COLOR FIDELITY CONTROL

TECHNICAL FIELD

Embodiments generally relate to displays. More particularly, embodiments relate to dynamic color fidelity control in RGBW (Red, Green, Blue, White) displays.

BACKGROUND

A conventional liquid crystal display (LCD) may include liquid crystals sandwiched between two pieces of thin glass substrate. Light emitted from backlight lamps may be controlled by the liquid crystals, wherein a color filter may be formed on one of the glass substrates in order to enable the display of color. Each pixel of a traditional Red, Green, Blue (RGB) color filter may include a three-subpixel configuration with a Red-Green-Blue component. Recent developments in color filter technology have resulted in the formulation of RGBW color filters, wherein each pixel of an RGBW color filter may include a two-subpixel configuration with either a Blue-White (BW) component or a Red-Green (RG) component. While RGBW color filters may increase transmissivity, resolution and power efficiency over traditional RGB color filters, yellow color saturation may be decreased due to a reduction of RG per full white ratio relative to the RGB color filter configuration.

BRIEF DESCRIPTION OF THE DRAWINGS

The various advantages of the embodiments will become apparent to one skilled in the art by reading the following specification and appended claims, and by referencing the following drawings, in which:

FIG. 2 is a block diagram of an example of a mode change approach according to an embodiment;

FIG. 3 is a flowchart of an example of a method of controlling color fidelity according to an embodiment;

FIG. 4 is an illustration of an example of a user interface according to an embodiment;

FIG. 5 is an illustration of an example of a pair of images and associated histograms according to an embodiment;

FIG. 6 is a block diagram of an example of a communication link according to an embodiment; and FIG. 7 is a block diagram of an example of a mobile device according to an embodiment.

DESCRIPTION OF EMBODIMENTS

Figure 1:
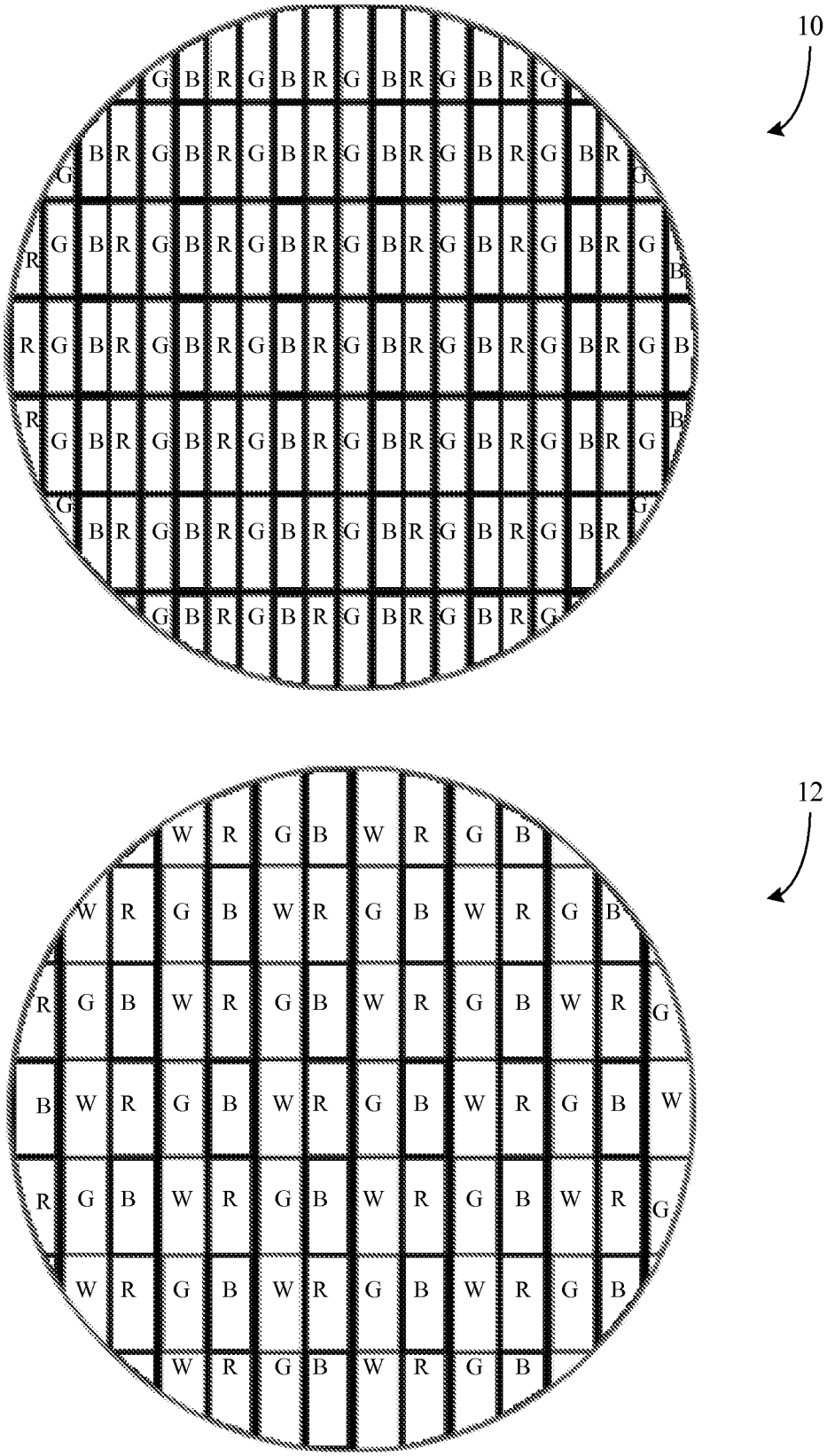
FIG. 1 is an illustration of an example of an RGB color filter layout and an RGBW color filter layout.

Turning now to FIG. 1, a set of color filter layouts is shown. The layouts may generally be used in a liquid crystal display (LCD) to enable the display of color. In the illustrated example, a Red, Green, Blue (RGB) layout 10 includes a three-subpixel configuration in which each pixel includes a Red-Green-Blue component. A Red, Green, Blue, White (RGBW) layout 12, on the other hand, may include a two-subpixel configuration in which each pixel includes either a Blue-White (BW) component or a Red-Green (RG) component. The white sub-pixel of each BW component may enable a relatively high amount of backlight energy to pass through the filter. As a result, power consumption may be reduced. Additionally, the greater width of the subpixels in the RGBW layout 12 may increase resolution and further enhance power efficiency. Of particular note, however, is that the RGBW layout 12 may include lower Red-Green (RG) per full white ratio than the RGB layout 10. Moreover, because red and green light combines to form yellow light, yellow saturation per full white may be more difficult to achieve via the RGBW layout 12 relative to the RGB layout 10. As will be discussed in greater detail, a dynamic color fidelity solution may be used to selectively boost the yellow-to-white (Y/W) luminance ratio of an RGBW display and obviate any concerns over yellow saturation or power consumption.

FIG. 2 shows a mode change approach for an RGBW display in which an RG pixel 14 has a dull yellow output 16 when the RGBW display is in a low power mode and a bright yellow output 18 when the RGBW display is in a high color fidelity mode. The mode change may generally be achieved by controlling the Y/W luminance ratio of the RGBW display. For example, a Y/W luminance ratio of 45% might be used in the low power mode, wherein the dull yellow output 16 may have a luminance of about 67.5 cd/m$^2$ and a white output 20 may have a luminance of about 150 cd/m$^2$ in such a scenario. In the high color fidelity mode, on the other hand, a Y/W luminance ratio of 90% might be used, wherein the bright yellow output 18 may have a luminance of about 135 cd/m$^2$ and a white output 22 may have a luminance of about 150 cd/m$^2$. The specific values used herein are only to facilitate discussion.

The decreased Y/W luminance ratio of the low power mode may lead to significantly less power consumption (e.g., 1.6 W) relative to the increased Y/W luminance ratio of the high color fidelity mode (e.g., 3.2 W). Thus, the decreased Y/W luminance ratio may be acceptable if battery life is a primary concern (e.g., in a mobile platform/device). By contrast, the increased Y/W luminance ratio of the high color fidelity mode may lead to significantly more yellow saturation relative to the decreased Y/W luminance ratio of the low power mode. Thus, the increased Y/W luminance ratio may be acceptable if color fidelity is a primary concern. In the illustrated example, a white output 24 would be identical in both the low power mode and the high color fidelity mode in terms of both luminance (e.g., about 150 cd/m$^2$) and power consumption (e.g., 1.6 W).

Turning now to FIG. 3, a method 26 of controlling color fidelity is shown. The method 26 may be implemented as a set of logic instructions stored in a machine- or computer-readable storage medium such as random access memory (RAM), read only memory (ROM), programmable ROM (PROM), firmware, flash memory, etc., in configurable logic such as, for example, programmable logic arrays (PLAs), field programmable gate arrays (FPGAs), complex programmable logic devices (CPLDs), in fixed-functionality logic hardware using circuit technology such as, for example, application specific integrated circuit (ASIC), complementary metal oxide semiconductor (CMOS) or transistor-transistor logic (TTL) technology, or any combination thereof. For example, computer program code to carry out operations shown in method 26 may be written in any combination of one or more programming languages, including an object oriented programming language such as Java, Smalltalk, C++ or the like and conventional procedural programming languages, such as the "C" programming language or similar programming languages.

Illustrated processing block 28 determines a mode of operation associated with an RGBW display. The mode of operation may be determined based on one or more user preferences and/or one or more images to be presented via the RGBW display. For example, FIG. 4 demonstrates that a user interface (UI) 30 may be generated in order to receive the user preferences. In the illustrated example, a slider bar 32 enables the user to establish a variable setting between "Maximum Battery" (e.g., low power mode) and "Maximum Quality" (e.g., high color fidelity mode). Table I below shows one example of a set of predetermined Y/W luminance ratios that may be used in conjunction with the slider bar 32.

TABLE I

| Power Mode | Fidelity Level | Y/W ratio (%) | Expected Color Fidelity in Equivalent Gamut (%) | Backlight Power (W) at 150 cd/m$^2$ |
|---|---|---|---|---|
| AC | 1 | 90 | 72 | 3.20 |
| DC | 1 | 90 | 72 | 3.20 |
| | 2 | 65 | 60 | 2.31 |
| | 3 | 50 | 50 | 1.78 |
| | 4 | 45 | 45 | 1.60 |
| | 5 | 36 | 40 | 1.28 |

Additionally, FIG. 5 demonstrates that if a high saturation image 34 is to be presented via the RGBW display, a value histogram 36 (e.g., hue, saturation, value/HSV histogram) may indicate a saturated color dominance in the image 34. In this regard, the hue (H) of a color may refer to which pure color it resembles (e.g., all tints, tones and shades of red have the same hue), the saturation (S) of a color may describe how white the color is (e.g., a pure red is fully saturated, with a saturation of one; tints of red have saturations less than one; and white has a saturation of zero). The lightness/value (V) of a color, on the other hand, may describe how dark the color is (e.g., a value of zero is black, with increasing lightness moving away from black).

Thus, if the value histogram 36 indicates a saturated color dominance, it may be inferred that the RGBW display is in a high color fidelity mode of operation. If, on the other hand, a low saturation image 38 is to be presented via the RGBW display, a value histogram 40 may indicate that the RGBW display can be placed in a low power mode of operation. Table II below shows a set of Y/W luminance ratios that may be used in conjunction with the histograms 36, 40.

TABLE II

| Power Mode | Saturation Level (>90% pixel count in histogram bin number) | Fidelity Level | Y/W ratio (%) | Expected Color Fidelity in Equivalent Gamut (%) | Backlight Power (W) at 150 cd/m$^2$ |
|---|---|---|---|---|---|
| AC | Any | 1 | 90 | 72 | 3.20 |
| DC | >bin28 | 1 | 90 | 72 | 3.20 |
| | >bin25 | 2 | 65 | 60 | 2.31 |
| | >bin22 | 3 | 50 | 50 | 1.78 |
| | >bin20 | 4 | 45 | 45 | 1.60 |
| | >bin18 | 5 | 36 | 40 | 1.28 |

Returning now to FIG. 3, if it is determined at block 42 that the RGBW display is in a low power mode, block 44 may set the Y/W luminance ratio of the RGBW to a relatively low value (e.g., decrease the Y/W luminance ratio). Such an approach may enable a significant reduction in power consumption and increase in battery life. If it is determined at block 42 that the RGBW display is not in the low power mode, the RGBW display may be in the high color fidelity mode and illustrated block 46 sets the Y/W luminance ratio to a relatively high value (e.g., increases the Y/W luminance ratio). Setting the Y/W luminance ratio to the relatively high value may improve quality.

FIG. 6 demonstrates one approach to controlling the Y/W luminance ratio. In the illustrated example, a communication link 48 (48*a*, 48*b*) between a processor 50 and an RGBW display 53 facilitates the transfer of color fidelity control information. The processor 50 may include logic 52 that is generally configured to provide the functionality of the aforementioned method 26 (FIG. 3). More particularly, an auxiliary link 48*b* may carry recognized extended display identification (EDID) information as well as ratio set commands between the logic 52 on the processor 50 and a timing controller (TCON) 54 on the RGBW display 53. The illustrated timing controller 54 includes various registers 56 such as an auxiliary register and/or an expand register to store commands and related information. A main link 48*a* may carry data to presented (e.g., images, video, visual content) via an LCD panel 58 having an RGBW color filter. In one example, the link 48 is compliant with a DisplayPort standard (e.g., Embedded DisplayPort Standard (eDP) Version 1.3, January 2011, Video Electronics Standards Association) and the color filter of the LCD panel 58 is a PENTILE RGBW color filter having a layout such as, for example, the RGBW layout 12 (FIG. 1), already discussed.

FIG. 7 shows a mobile device 60. The mobile device 60 may be part of a platform having computing functionality (e.g., personal digital assistant/PDA, laptop, smart tablet), communications functionality (e.g., wireless smart phone), imaging functionality, media playing functionality (e.g., smart television/TV), or any combination thereof (e.g., mobile Internet device/MID). In the illustrated example, the device 60 includes a battery 72 to supply power to the system and a processor 50 having an integrated memory controller (IMC) 64, which may communicate with system memory 66. The system memory 66 may include, for example, dynamic random access memory (DRAM) configured as one or more memory modules such as, for example, dual inline memory modules (DIMMs), small outline DIMMs (SODIMMs), etc.

The illustrated device 60 also includes a input output (IO) module 68, sometimes referred to as a Southbridge of a chipset, that functions as a host device and may communicate with, for example, an RGBW display 53 and mass storage 70 (e.g., hard disk drive/HDD, optical disk, flash memory, etc.). The illustrated processor 62 may execute logic 52 that is configured to determine a mode of operation associated with the RGBW display 53 based on a user preference, an image to be presented on the RGBW display 53, and so forth. The user preference might be obtained via the display 53 (e.g., touch screen) or other user input device such as a keyboard, keypad, microphone, mouse, etc. The image to be presented on the RGBW display 53 may be obtained from the system memory 66, mass storage 70, another on-platform source, another off-platform source, etc.

The logic 52 may also control a Y/W luminance ratio of the RGBW display 53 based on the mode of operation. For example, the logic 52 might decrease the Y/W luminance ratio if the RGBW display 53 is in a low power mode and increase the Y/W luminance ratio if the RGBW display 53 is in a high color fidelity mode. The logic 52 may alternatively be implemented external to the processor 50. Additionally, the processor 50 and the IO module 68 may be implemented together on the same semiconductor die as a system on chip (SoC).

ADDITIONAL NOTES AND EXAMPLES

Example 1 may include a system to control color fidelity, comprising a battery to supply power to the system, a Red, Green, Blue, White (RGBW) display, and logic, implemented at least partly in fixed-functionality hardware, to determine a mode of operation associated with the RGBW display and control a yellow-to-white (Y/W) luminance ratio of the RGBW display based on the mode of operation.

Example 2 may include the system of Example 1, wherein the logic is to decrease the Y/W luminance ratio if the RGBW display is in a low power mode, and increase the Y/W luminance ratio if the RGBW display is in a high color fidelity mode.

Example 3 may include the system of any one of Examples 1 or 2, wherein the mode of operation is to be determined based on a user preference.

Example 4 may include the system of Example 3, wherein the logic is to generate a user interface (UI), and receive the user preference via the UI.

Example 5 may include the system of any one of Examples 1 or 2, wherein the mode of operation is to be determined based on an image.

Example 6 may include the system of Example 5, wherein the logic is to select a high color fidelity mode of operation if a histogram associated with the image indicates a saturated color dominance, and select a low power mode of operation if the histogram associated with the image does not indicate a saturated color dominance.

Example 7 may include an apparatus to control color fidelity, comprising logic, implemented at least partly in fixed-functionality hardware, to determine a mode of operation associated with a Red, Green, Blue, White (RGBW) display and control a yellow-to-white (Y/W) luminance ratio of the RGBW display based on the mode of operation.

Example 8 may include the apparatus of Example 7, wherein the logic is to decrease the Y/W luminance ratio if the RGBW display is in a low power mode, and increase the Y/W luminance ratio if the RGBW display is in a high color fidelity mode.

Example 9 may include the apparatus of any one of Examples 7 or 8, wherein the mode of operation is to be determined based on a user preference.

Example 10 may include the apparatus of Example 9, wherein the logic is to generate a user interface (UI), and receive the user preference via the UI.

Example 11 may include the apparatus of any one of Examples 7 or 8, wherein the mode of operation is to be determined based on an image.

Example 12 may include the apparatus of Example 11, wherein the logic is to select a high color fidelity mode of operation if a histogram associated with the image indicates a saturated color dominance, and select a low power mode of operation if the histogram associated with the image does not indicate a saturated color dominance.

Example 13 may include a method of controlling color fidelity, comprising determining a mode of operation associated with a Red, Green, Blue, White (RGBW) display and controlling a yellow-to-white (Y/W) luminance ratio of the RGBW display based on the mode of operation.

Example 14 may include the method of Example 13, wherein controlling the Y/W luminance ratio includes decreasing the Y/W luminance ratio if the RGBW display is in a low power mode, and increasing the Y/W luminance ratio if the RGBW display is in a high color fidelity mode.

Example 15 may include the method of any one of Examples 13 or 14, wherein the mode of operation is determined based on a user preference.

Example 16 may include the method of Example 15, further including generating a user interface (UI), and receiving the user preference via the UI.

Example 17 may include the method of any one of Examples 13 or 14, wherein the mode of operation is determined based on an image.

Example 18 may include the method of Example 17, further including selecting a high color fidelity mode of operation if a histogram associated with the image indicates a saturated color dominance, and selecting a low power mode of operation if the histogram associated with the image does not indicate a saturated color dominance.

Example 19 may include a non-transitory computer readable storage medium comprising a set of instructions which, if executed by a device, cause the device to determine a mode of operation associated with a Red, Green, Blue, White (RGBW) display and control a yellow-to-white (Y/W) luminance ratio of the RGBW display based on the mode of operation.

Example 20 may include a non-transitory computer readable storage medium comprising a set of instructions which, if executed by a device, cause the device to perform the method of any one of Examples 13 to 18.

Example 21 may include an apparatus to control color fidelity, comprising means for performing the method of any one of Examples 13 to 18.

Thus, techniques described herein may provide an optimal power and quality design point for various usage cases on a given platform. Indeed, multi-purpose usage devices such as laptop computers and tablets may use these techniques to obviate any need to compromise power for quality, or vice versa, across a wide variety of usage cases.

Embodiments are applicable for use with all types of semiconductor integrated circuit ("IC") chips. Examples of these IC chips include but are not limited to processors, controllers, chipset components, programmable logic arrays (PLAs), memory chips, network chips, systems on chip (SoCs), SSD/NAND controller ASICs, and the like. In addition, in some of the drawings, signal conductor lines are represented with lines. Some may be different, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

Example sizes/models/values/ranges may have been given, although embodiments are not limited to the same. As manufacturing techniques (e.g., photolithography) mature over time, it is expected that devices of smaller size could be manufactured. In addition, well known power/ground connections to IC chips and other components may or may not be shown within the figures, for simplicity of illustration and discussion, and so as not to obscure certain aspects of the embodiments. Further, arrangements may be shown in block diagram form in order to avoid obscuring embodiments, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments, it should be apparent to one skilled in the art that embodiments can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. may be used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

I claim:

1. A system comprising:

a battery to supply power to the system;

a Red, Green, Blue, White (RGBW) display; and logic, implemented at least partly in fixed-functionality hardware, to, determine a mode of operation associated with the RGBW display, and control a yellow-to-white (Y/W) luminance ratio of the RGBW display based on the mode of operation to decrease the Y/W luminance ratio if the RGBW display is in a low power mode, and increase the Y/W luminance ratio if the RGBW display is in a high color fidelity mode.

2. The system of claim 1, wherein the mode of operation is to be determined based on a user preference.

3. The system of claim 2, wherein the logic is to, generate a user interface (UI); and receive the user preference via the UI.

4. The system of claim 1, wherein the mode of operation is to be determined based on an image.

5. The system of claim 4, wherein the logic is to, select a high color fidelity mode of operation if a histogram associated with the image indicates a saturated color dominance, and select a low power mode of operation if the histogram associated with the image does not indicate a saturated color dominance.

6. An apparatus comprising:

logic, implemented at least partly in fixed-functionality hardware, to, determine a mode of operation associated with a Red, Green, Blue, White (RGBW) display, and control a yellow-to-white (Y/W) luminance ratio of the RGBW display based on the mode of operation to decrease the Y/W luminance ratio if the RGBW display is in a low power mode, and increase the Y/W luminance ratio if the RGBW display is in a high color fidelity mode.

7. The apparatus of claim 6, wherein the mode of operation is to be determined based on a user preference.

8. The apparatus of claim 7, wherein the logic is to, generate a user interface (UI); and receive the user preference via the UI.

9. The apparatus of claim 6, wherein the mode of operation is to be determined based on an image.

10. The apparatus of claim 9, wherein the logic is to, select a high color fidelity mode of operation if a histogram associated with the image indicates a saturated color dominance, and select a low power mode of operation if the histogram associated with the image does not indicate a saturated color dominance.

11. A method comprising:

determining a mode of operation associated with a Red, Green, Blue, White (RGBW) display; and controlling a yellow-to-white (Y/W) luminance ratio of the RGBW display based on the mode of operation wherein controlling the Y/W luminance ratio includes:

decreasing the Y/W luminance ratio if the RGBW display is in a low power mode; and increasing the Y/W luminance ratio if the RGBW display is in a high color fidelity mode.

12. The method of claim 11, wherein the mode of operation is determined based on a user preference.

13. The method of claim 12, further including:

generating a user interface (UI); and receiving the user preference via the UI.

14. The method of claim 11, wherein the mode of operation is determined based on an image.

15. The method of claim 14, further including:

selecting a high color fidelity mode of operation if a histogram associated with the image indicates a saturated color dominance; and selecting a low power mode of operation if the histogram associated with the image does not indicate a saturated color dominance.

16. A non-transitory computer readable storage medium comprising a set of instructions which, if executed by a device, cause the device to:

determine a mode of operation associated with a Red, Green, Blue, White (RGBW) display; and control a yellow-to-white (Y/W) luminance ratio of the RGBW display based on the mode of operation to decrease the Y/W luminance ratio if the RGBW display is in a low power mode; and increase the Y/W luminance ratio if the RGWB display is in a high color fidelity mode.

17. The medium of claim 16, wherein the mode of operation is to be determined based on a user preference.

18. The medium of claim 17, wherein the instructions, if executed, cause a device to:

generate a user interface (UI); and receive the user preference via the UI.

19. The medium of claim 16, wherein the mode of operation is to be determined based on an image.

20. The medium of claim 19, wherein the instructions, if executed, cause a device to:

select a high color fidelity mode of operation if a histogram associated with the image indicates a saturated color dominance; and select a low power mode of operation if the histogram associated with the image does not indicate a saturated color dominance.

* * * * *